US007481406B2

(12) United States Patent
Lang et al.

(10) Patent No.: US 7,481,406 B2
(45) Date of Patent: Jan. 27, 2009

(54) PLASTIC PEGBOARD ASSEMBLY

(75) Inventors: Gerard William Lang, Baltimore, MD (US); Benjamin M. Harvey, New Market, MD (US); Eric Sugalski, Chicago, IL (US); Brian Brigham, Chicago, IL (US)

(73) Assignee: Newell Operating Company, Atlanta, GA (US)

( * ) Notice: Subject to any disclaimer, the term of this patent is extended or adjusted under 35 U.S.C. 154(b) by 0 days.

(21) Appl. No.: 11/455,952

(22) Filed: Jun. 20, 2006

(65) Prior Publication Data

US 2007/0290107 A1 Dec. 20, 2007

(51) Int. Cl.

| | |
|---|---|
| ***A47B 96/06*** | (2006.01) |
| ***A47G 29/00*** | (2006.01) |
| ***A47K 1/00*** | (2006.01) |
| ***E04G 3/00*** | (2006.01) |
| ***E04G 5/06*** | (2006.01) |
| ***F21V 21/00*** | (2006.01) |
| ***F21V 35/00*** | (2006.01) |

(52) U.S. Cl. ..... 248/220.31; 248/220.41; 248/220.42; 52/586.1; 52/586.2

(58) Field of Classification Search ..... 248/220.31, 248/220.41, 220.42; 52/586.1, 586.2; 403/339, 403/340, 364

See application file for complete search history.

(56) References Cited

U.S. PATENT DOCUMENTS

| | | | | | |
|---|---|---|---|---|---|
| 1,067,792 | A | * | 7/1913 | Baron | 52/283 |
| 2,017,441 | A | * | 10/1935 | Kotrbaty | 52/733.4 |
| 2,551,539 | A | | 5/1951 | Horton | |
| 3,160,249 | A | * | 12/1964 | Pavlecka | 52/586.2 |
| 3,306,564 | A | | 2/1967 | Nickel | |
| 3,322,287 | A | | 5/1967 | Ragir | |
| 3,348,459 | A | * | 10/1967 | Harvey | 404/35 |
| 3,452,959 | A | * | 7/1969 | Ishikawa | 248/488 |
| 3,497,079 | A | | 2/1970 | Kulwiec | |
| 3,512,819 | A | * | 5/1970 | Gillingwater et al. | 52/461 |
| 3,602,159 | A | * | 8/1971 | Marschak | 108/187 |
| 3,640,039 | A | * | 2/1972 | McKee et al. | 52/281 |
| 3,648,393 | A | * | 3/1972 | Parrilla | 40/730 |
| 3,931,894 | A | | 1/1976 | Murphy | |
| 3,953,633 | A | | 4/1976 | Noonan | |
| 4,014,774 | A | | 3/1977 | Noonan | |
| 4,319,531 | A | * | 3/1982 | Caldwell | 108/152 |
| 4,467,990 | A | | 8/1984 | Wiseman | |

(Continued)

OTHER PUBLICATIONS

Acclaim Design & Profiles Inc., Plastic Pegboard, http://www.acclaimdesign.on.ca/plastic_pegboard.htm, Oct. 20, 2005.

(Continued)

*Primary Examiner*—J. Allen Shriver
*Assistant Examiner*—Michael McDuffie
(74) *Attorney, Agent, or Firm*—Banner & Witcoff, Ltd.

(57) ABSTRACT

A pegboard assembly is secured in a spaced relation against a wall. The pegboard assembly has a plurality of pegboard members, in which a first pegboard member is coupled to a second pegboard member by a connector. The pegboard member has a front side and a rear side, and has a plurality of holes defined therethrough. The rear side has an integral spacer element and is adapted to contact the wall such that the holes are adapted to be spaced from the wall.

5 Claims, 4 Drawing Sheets

U.S. PATENT DOCUMENTS

| | | | | |
|---|---|---|---|---|
| 4,594,829 | A * | 6/1986 | Herrgord | 52/282.3 |
| 4,932,538 | A * | 6/1990 | Gambello | 211/87.01 |
| 4,951,827 | A * | 8/1990 | Moransais | 211/59.1 |
| 4,953,338 | A * | 9/1990 | Wilson et al. | 52/586.2 |
| 5,014,478 | A * | 5/1991 | Spring | 52/281 |
| 5,179,810 | A * | 1/1993 | Gename et al. | 52/240 |
| 5,220,952 | A * | 6/1993 | Beaulieu | 160/231.1 |
| 5,515,900 | A * | 5/1996 | West et al. | 160/135 |
| 5,673,803 | A | 10/1997 | Burback | |
| 5,749,194 | A | 5/1998 | Andres et al. | |
| 5,927,517 | A | 7/1999 | Lipman et al. | |
| 6,003,686 | A * | 12/1999 | Pichler | 211/39 |
| 6,015,124 | A * | 1/2000 | Loy | 248/220.31 |
| 6,418,683 | B1 * | 7/2002 | Martensson et al. | 52/282.1 |
| 6,481,584 | B1 * | 11/2002 | Cantley | 211/87.01 |
| 6,553,731 | B2 * | 4/2003 | Hsueh | 52/239 |
| 6,631,813 | B1 * | 10/2003 | Walter et al. | 211/94.01 |
| D491,287 | S | 6/2004 | Winig et al. | |
| 6,837,384 | B2 * | 1/2005 | Secondino | 211/87.01 |
| 2002/0170259 | A1 * | 11/2002 | Ferris | 52/596 |
| 2003/0163967 | A1 * | 9/2003 | Sims | 52/586.2 |
| 2003/0189020 | A1 | 10/2003 | Secondino | |
| 2004/0226901 | A1 | 11/2004 | Berg | |

OTHER PUBLICATIONS

APC Hookstore, Plastic Peg Panels & Racks, Kwik-Panels, Kwik Panel Jr., Peg Wall, Key and Cell Phone Rack, Belt Rack, Scarf Rack, Peg Panel Office, Peg Panel CD, http://www.hookstore.com/panels.htm, Oct. 20, 2005.

Pik-A-Nut, Pegboard 9855 photographs, obtained Oct. 2005.

* cited by examiner

PLASTIC PEGBOARD ASSEMBLY

CROSS-REFERENCE TO RELATED APPLICATIONS

None.

FEDERALLY SPONSORED RESEARCH OR DEVELOPMENT

None.

TECHNICAL FIELD

The invention relates to a plastic pegboard assembly comprising a plurality of pegboard members that are coupled by a connector and secured in a spaced relation from a wall.

BACKGROUND OF THE INVENTION

Display wall panels such as pegboards are commonly known in the art. Pegboard panels are frequently used to display or store items, tools, supplies or accessories along a wall without contacting the finished wall behind the pegboard. Pegboards are most commonly found in garages, work sheds or utility rooms, in which there may be less room for bulky storage containers. Wall storage is, therefore, a practical solution. Typically, pegboards are available in large sheets, having a pre-determined size and configuration, and must be mounted using additional mounting hardware that appropriately space the pegboard a certain distance from the wall. The pegboards are commonly made of wood including wood particle board. The large pegboard sheets can be cumbersome to handle and difficult to mount. Furthermore, the final mounting of a plurality of adjacent pegboards is often times not aesthetically pleasing to users.

While such pegboards, according to the prior art, provide a number of advantageous features, they nevertheless have certain limitations. The present invention is provided to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention provides for a pegboard assembly configured to couple a plurality of pegboard members and be secured in a spaced relation against a wall. In one preferred embodiment, a pegboard assembly is provided having a plurality of pegboard members, in which the first pegboard member is coupled to the second pegboard member by a connector. In one preferred embodiment, the pegboard members are plastic.

According to a first aspect of the invention, a pegboard assembly is provided having a plurality of pegboard members. The pegboard member has a front side and a rear side, and has a plurality of holes defined therethrough. The rear side has a plurality of reinforcement ribs having an integral spacer element. The spacer element extends from the reinforcing rib, and is adapted to contact the wall such that the holes are adapted to be spaced from the wall.

According to another aspect of the invention, a pegboard assembly is provided having a plurality of pegboard members. The plurality of pegboard members are operably connected by a connector. The pegboard members and connector have a cooperative structure to connect the pegboard members. In one preferred embodiment, the pegboard members have a generally T-shaped tongue that is received by a generally T-shaped groove in the connector.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
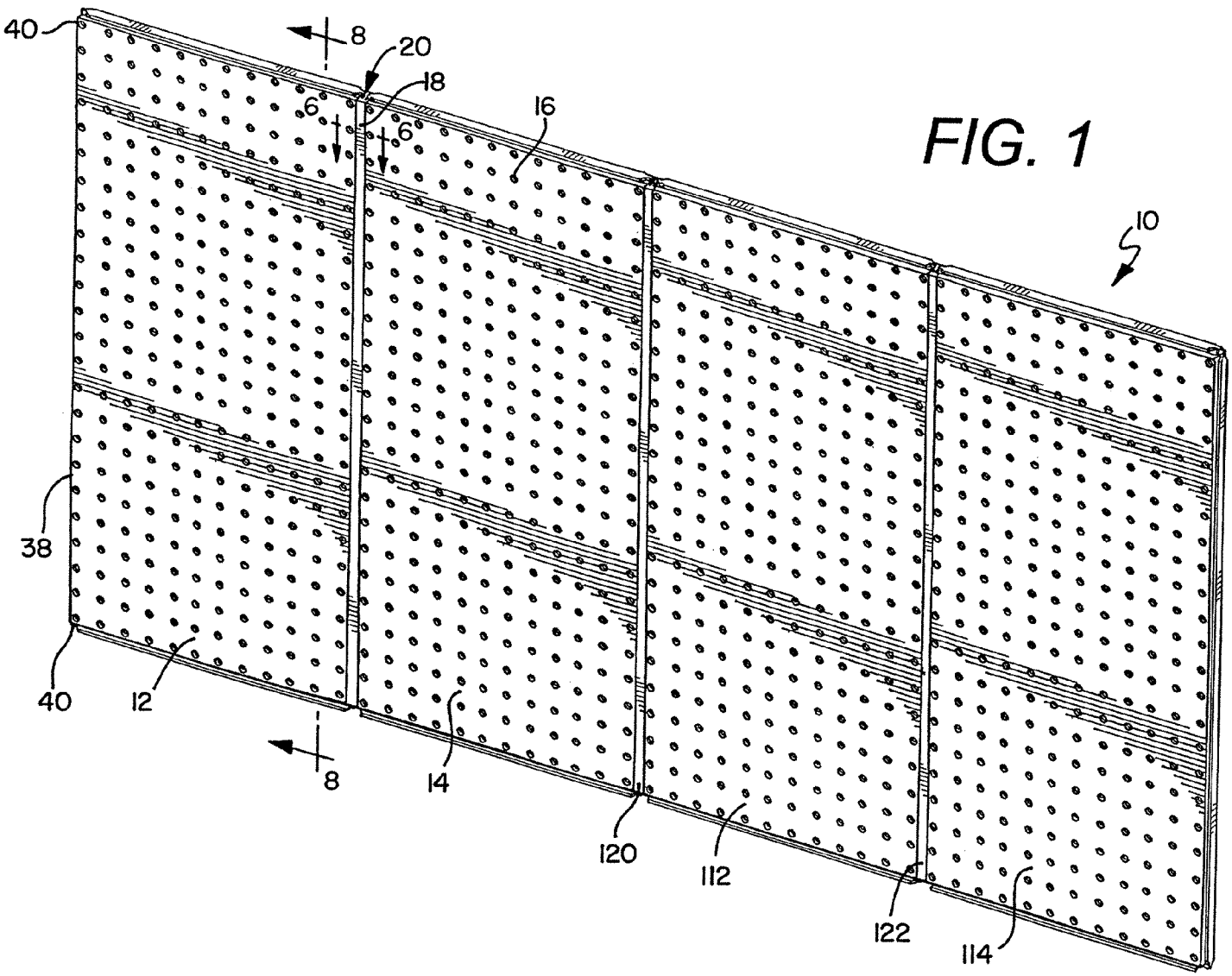
FIG. 1 is a perspective view of a pegboard assembly according to the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
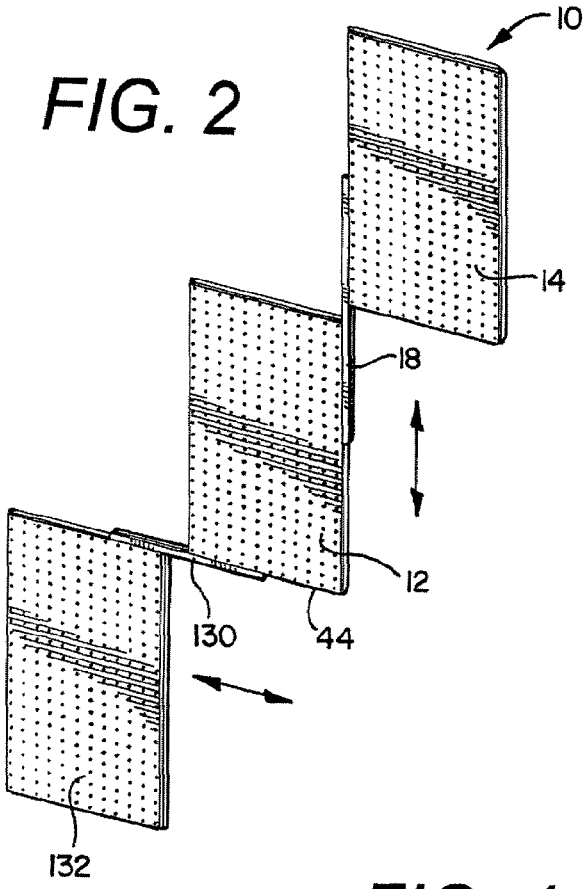
FIG. 2 is a perspective view of the pegboard assembly according to the present invention, showing pegboard members being connected by a connector and showing additional connection configurations.
Figure 5:
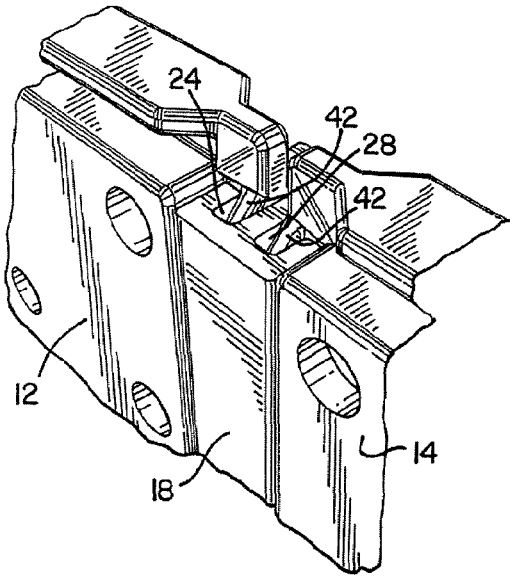
FIG. 5 is a partial perspective view of a first pegboard member, a second pegboard member, and a connector according to the present invention.

Referring to the drawings, FIG. 1 discloses a plastic pegboard assembly according to the present invention, generally designated by the reference numeral 10. As shown in FIGS. 1 and 2, the pegboard assembly 10 generally has a first pegboard member 12, a second pegboard member 14, and a connector 18. FIGS. 2 and 5 show a first pegboard member 12 and a second pegboard member 14 coupled with the connector 18 that will be discussed in greater detail below. The pegboard members 12,14 are generally identical. The pegboard assembly 10 is designed to be mounted on the wall in any number of desired configurations as shown in FIG. 2 such as in a horizontal position or in a vertical position. The number of pegboard members that are used will vary depending on the desired size of the entire pegboard assembly 10. Accordingly, as shown in FIG. 1, additional connectors 18 can be utilized to connect a third pegboard member 112 to the second pegboard member 14 and a fourth pegboard member 114 can be connected to the third pegboard member 112. Other combinations of pegboard members 12 can also be utilized and this will be described in greater detail below.

As shown in FIG. 1, a cooperative structure 20 is utilized between the pegboard members 12,14 and the connector 18. The cooperative structure 20 allows for the pegboard members 12,14 to fit securely into the connector 18 resulting in the pegboard assembly 10. The cooperative structure 20 generally comprises a structural feature between the pegboard member 12 and the connector 18 to allow for additional connections between pegboard members 12. The connector 18 operates as a part of the cooperative structure 20 between the first pegboard 12 and the second pegboard 14 for coupling the first pegboard 12 to the second pegboard 14. As discussed in greater detail below, a tongue and groove arrangement is one preferred embodiment of the cooperative structure 20 although other structures could be utilized.

Figure 7:
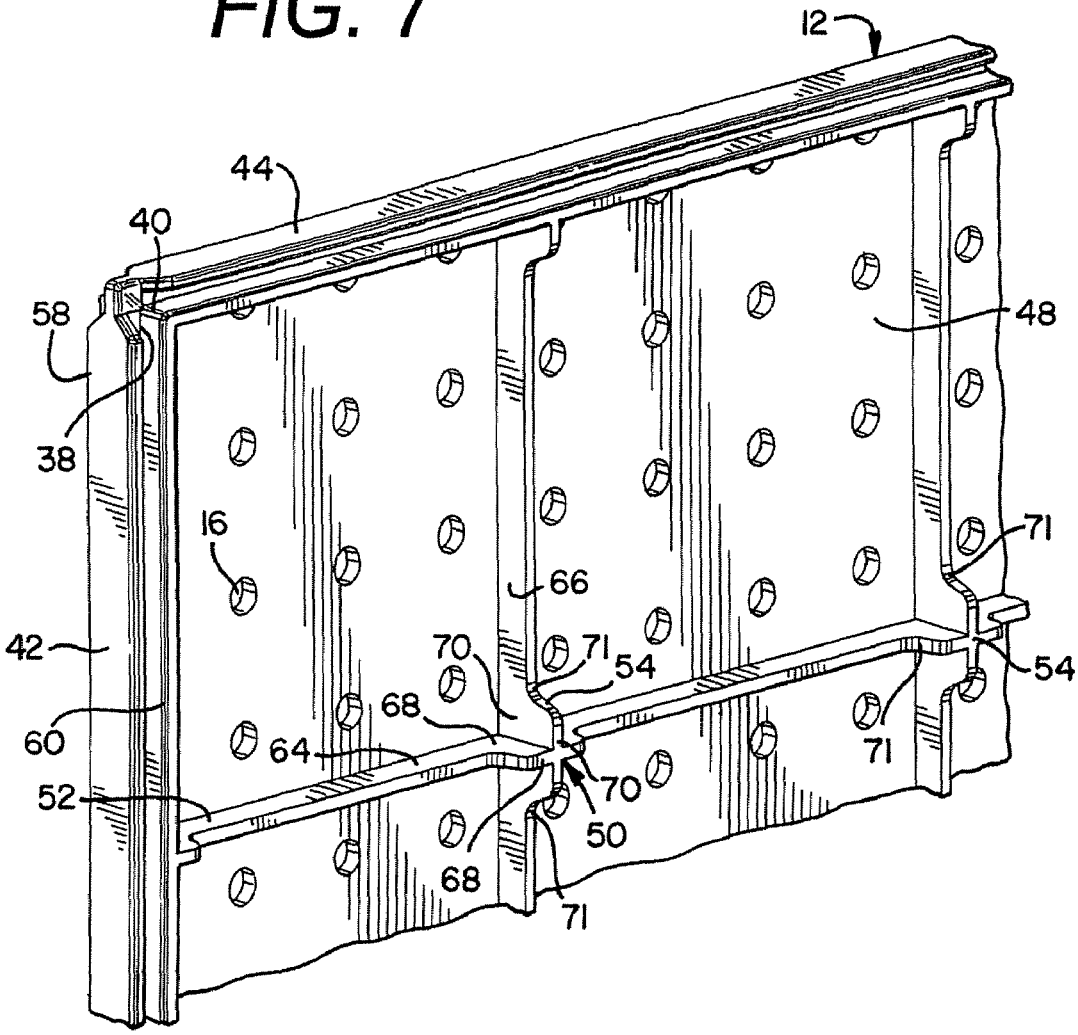
FIG. 7 is a partial rear view of the pegboard member of the present invention.
Figure 8:
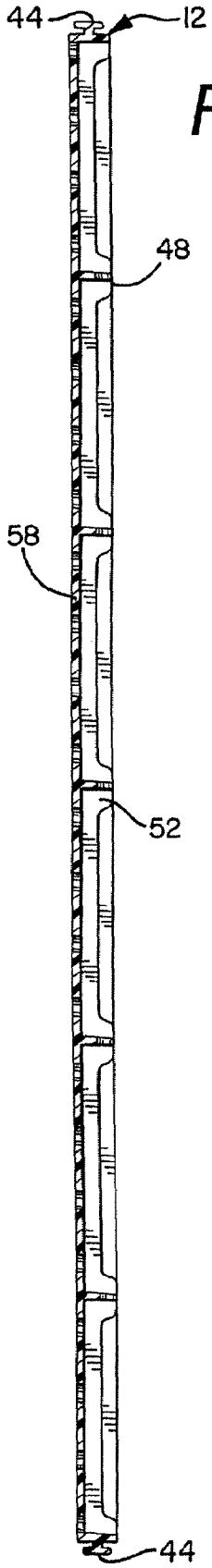
FIG. 8 is a cross-sectional view taken along lines 8-8 of the pegboard member of FIG. 1.

The particular pegboard members 12 shown in FIG. 1 are made of plastic although they could also be made from other materials including wood. Thus, in one preferred embodiment, the pegboard members 12 can be made from a plastic injection-molded process as is understood in the art. The structure of the first pegboard member 12 will be described with the understanding that the structure of other pegboard members 14,112,114 are generally identical. FIG. 1 shows the pegboard member 12 having a plurality of holes 16 defined therethrough. The plurality of holes 16 may be arranged at regular intervals or intermittently throughout the pegboard members 12. As shown in FIGS. 7 and 8, the pegboard member 12 has a front side 58 and a rear side 48 that are generally planar. The front side 58 has a generally smooth surface. The rear side 48 also has a generally smooth surface but has a plurality of reinforcing ribs 52 extending from the rear side 48. The reinforcing ribs 52 will be discussed in greater detail below. In one preferred embodiment, the pegboard member 12 is generally rectangular although other shapes are readily possible.

Figure 3:
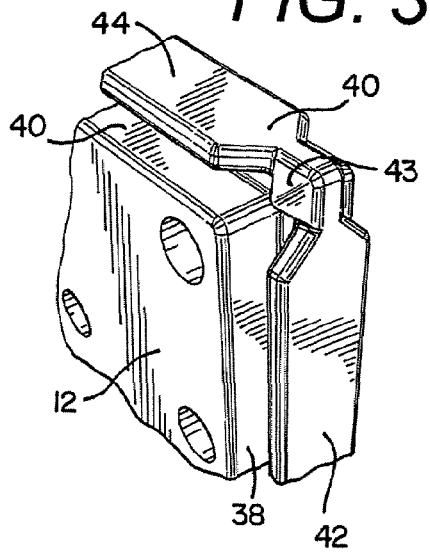
FIG. 3 is a partial perspective view of an edge of a pegboard member according to the present invention.

As shown in FIGS. 1-3, the pegboard member 12 has a first peripheral edge 38 and a second peripheral edge 40. The second peripheral edge 40 is generally transverse to the first peripheral edge 38. The first peripheral edge 38 is generally vertically-oriented in FIG. 3 and the second peripheral edge 40 is generally horizontally-oriented in FIG. 3. It is understood that the pegboard member 12 may generally have a pair of vertically-oriented peripheral edges 38 and a pair of horizontally-oriented peripheral edges 40. The peripheral edge 38 has a first tongue 42 extending therefrom. The second peripheral edge 40 also has a second tongue 44 extending therefrom. The second tongue 44 extends generally transverse to the first tongue 42. In a preferred embodiment as shown in FIG. 3, the tongues 42,44 join at a corner of the pegboard member 12. At this corner and shown in FIGS. 3 and 4, a flared ridge 43 is formed at generally an interface between the first tongue 42 and the second tongue 44. The flared ridge 43 acts as a stop structure in cooperation with the connector 18 as described in greater detail below. The As can be understood from FIGS. 3-6, the tongues 42,44 extend substantially perpendicular from the peripheral edges 38,40 and are integral with the pegboard member 12. In one preferred embodiment, the tongues 42,44 have a T-shape, formed by a first member intersecting a cross-member. While the present invention has a tongue in the shape of a T, it is contemplated that the tongue 42,44 can be of various shapes and configurations providing for cooperation with the connector 18 as further described below. Thus, in a preferred embodiment, the first plastic pegboard member 12 has generally T-shaped tongues 42,44 extending from the peripheral edges 38,40 and around the full periphery of the pegboard member 12. The tongues 42,44 cooperate with the connector 18.

As shown in FIG. 7, the rear side 48 of the first pegboard member 12 has a reinforcing rib 52 that operates to add further support to the pegboard member 12 by strengthening and stiffening the pegboard member 12. The pegboard member 12 may also have a depending flange 60 extending around a periphery of the pegboard member 12 that also may add rigidity and stiffness to the pegboard member 12. As further shown in FIG. 7, the reinforcing rib 52 has a first reinforcing member 64 and a second reinforcing member 66. The first reinforcing member 64 intersects the second reinforcing member 66 at an intersection area 54. It is understood that the reinforcing rib 52 has a plurality of intersecting first reinforcing members 64 and second reinforcing members 66 that make up a grid like structure on the rear side 48 of the pegboard member 12. As further shown in FIG. 7, a spacer element 50 extends from the intersection area 54. Each of the intersecting areas 54 has a spacer element 50 extending therefrom as can be understood from FIG. 7. The spacer element 50 extends from the reinforcing rib 52, and is integral with the reinforcing rib 52. In a preferred embodiment, the spacer element 50 has a first spacer member 68 and a second spacer member 70. The first spacer member 68 intersects the second spacer member 70 thus forming a cross shape. As further shown in FIG. 7, the first spacer member 68 extends from the first reinforcing member 64, and the second spacer member 70 extends from the second reinforcing member 66, generally at the intersection area 54. The spacer members 68,70 of the spacer element 52 define engaging surfaces to abut a wall and further having a generally curved segment 71 that meets the reinforcing members 64,66. In a preferred embodiment, the spacer element 50 and the reinforcing rib 52 are integral with the rear side 48 of the pegboard member 12 and formed in an injection molding process with the overall pegboard member 12.

Figure 9:
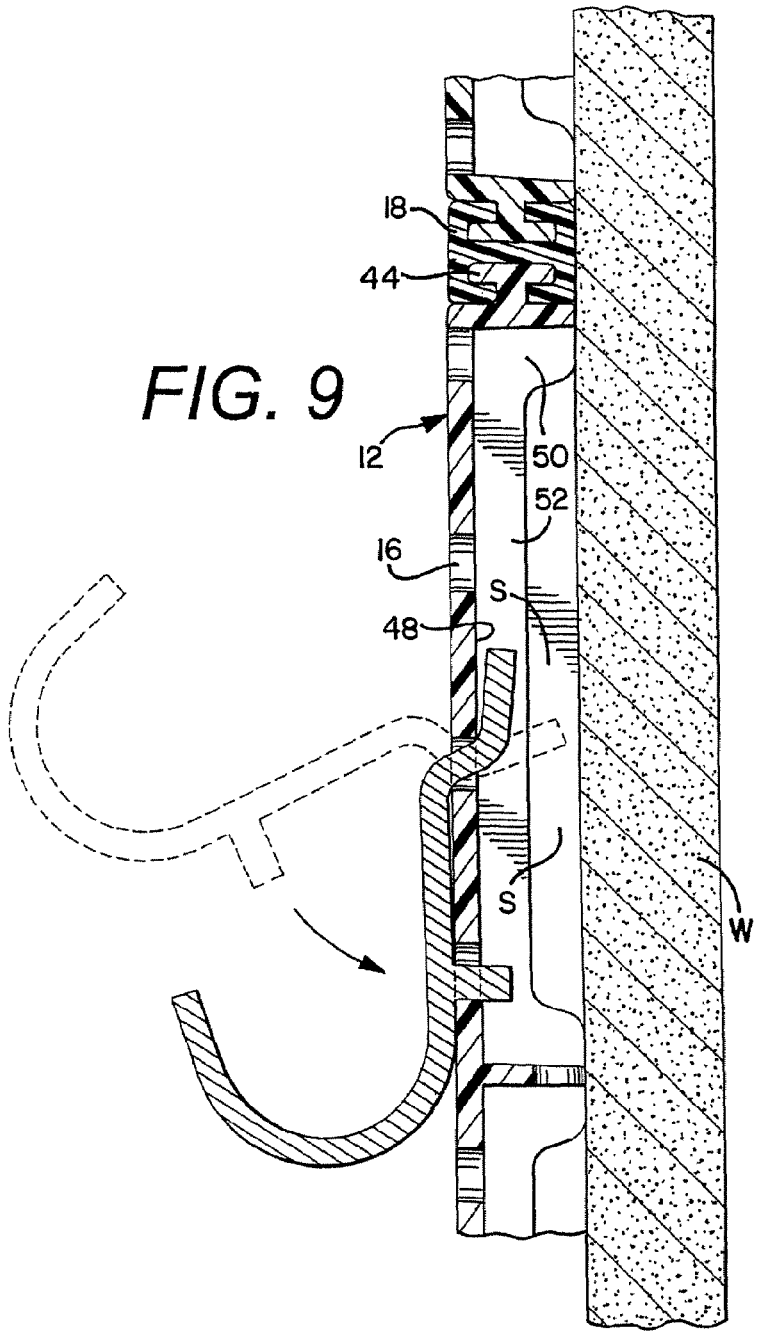
FIG. 9 is a partial schematic cross-sectional view of the pegboard assembly mounted to a wall and showing a hook mounted on the pegboard assembly.

The spacer element 50 operates to contact the wall W upon mounting the pegboard assembly 10, such that the holes 16 are spaced from the wall W as shown in FIG. 9. The spacer element 50 thus ensures that the plurality of holes 16 are spaced a distance from the mounting wall when installed in order to accommodate hooks or other mounting accessories through the holes 16. Thus, as shown in FIG. 9, the spacer element 50 is designed to provide a space S between the rear side 48 of the pegboard 12 and the mounting wall W to allow any standard pegboard hooks or other accessories to fit into the plurality of holes 16 of the pegboard member 12.

Figure 4:
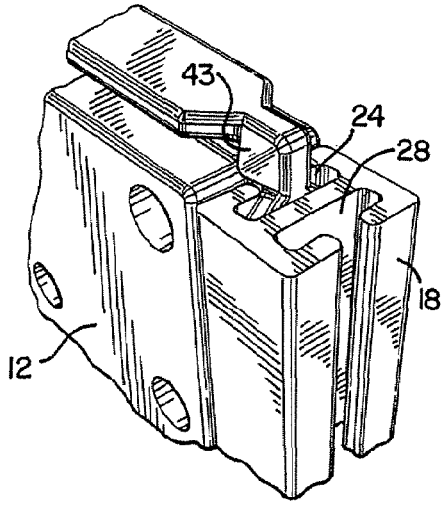
FIG. 4 is a partial perspective view of a pegboard member and a connector according to the present invention.
Figure 6:
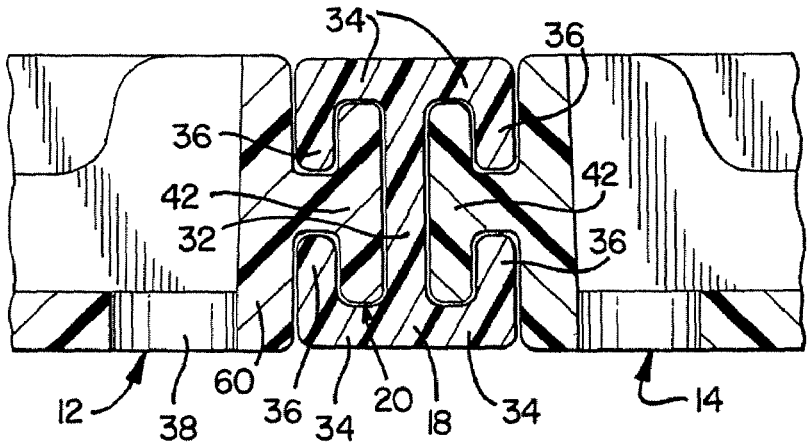
FIG. 6 is a cross-sectional view of FIG. 1 taken along lines 6-6 of the pegboard assembly of FIG. 1.

FIGS. 1, 2 and 4-6 show the connector 18. The connector 18 generally defines a first groove and a second groove that in a preferred embodiment, are generally T-shaped grooves. As shown in FIG. 6, the connector 18 has a base 32, a first pair of opposing walls 34 extending from the base 32 in one direction, and a pair of shoulders 36 extending inwardly from the pair of the opposing walls 34. The connector 18 also has a second pair of opposing walls 34 extending in an opposite direction from the base 32. A second pair of shoulders 36 extend inwardly from the second pair of opposing walls 34. The base 32, the pairs of opposing walls 34, and the pairs of shoulders 36 cooperatively define the first groove 24 and the second groove 28 of the connector 18. In a preferred embodiment, the first groove 24 and the second groove 28 are generally T-shaped grooves. As shown in FIGS. 4-6, it is understood that the connector 18 thus defines the first T-shaped groove 24 opposite the second T-shaped groove 28. As explained in greater detail below, the T-shaped grooves 24,28 receive the T-shaped tongues 42,44 of the pegboard member 12. Also, in one preferred embodiment, the grooves 24,28 extend the length of the connector 18 and are open at each end. In an alternative embodiment, one end of the connector 18 can be closed, thus closing off the grooves 24,28 at one end. This structure would help support the pegboard members 12,14 as further discussed below.

One aspect of the present invention allows a user to create the pegboard assembly 10 according to a desired size or configuration. Thus, by utilizing the cooperative structure 20 between the pegboard member 12 and the connector 18, a user can assemble the pegboard assembly 10 in a number of different configurations.

For example, FIG. 1 shows a pegboard assembly 10 having four pegboard members interconnected by three connectors 18. It is understood that the pegboard members 12 may be suitably mounted to a mounting surface such as a wall using a variety of known mounting hardware. For example, traditional screws, drywall anchors or other hardware can be used. The holes 16 in the pegboard members 12,14 can be used in mounting the pegboard members 12,14. As shown in FIG. 9, the spacer elements 50 assure that a space S is maintained between the rear side 48 of the pegboard 12 and the wall W. The second pegboard 14 is connected to the first pegboard member 12. As can be understood from FIGS. 1 and 4-6, the first tongue 42 of the first pegboard member 12 is received in the first groove 24 of the connector 18 wherein the connector 18 is operably connected to the first pegboard member 12. As shown in FIGS. 1 and 5, the first tongue 42 of the second pegboard member 14 is then received in the second groove 28 of the first connector 18 wherein the second pegboard member 14 is operably connected or coupled to the first pegboard member 12. As shown in FIG. 6, the base 32, opposing walls 34 and shoulders 38 cooperate to engage the T-shaped tongue 42,44 of the pegboard members 12,14. It is understood that the grooves 24,28 of the connector 18 and the tongues 42,44 are dimensioned such that there is suitable friction therebetween. Thus as shown in FIG. 6, the grooves 24,28 and tongues 42,44 can be structured such that there is frictional engagement between their respective surfaces. The frictional engagement prevents the connector 18 from sliding out of the pegboard members 12,14 and helps secure the pegboard assembly 10. It is understood that the design provides sufficient friction to keep the connector 18 and pegboard members 12,14 engaged as desired but allowing the connector 18 to be slid along the tongues 42,44 of the pegboard members 12,14. It is further understood that the frictional engagement configuration could be the only means employed to prevent the connector 18 from sliding out of the pegboard members 12,14. In such configuration, the flared ridge 43 or utilizing a connector 18 having a closed end are not employed. However, in one embodiment, and as can be understood from FIG. 4, the flared ridge 43 helps in acting as a stop structure so that the pegboard members 12,14 cannot slide out of the connector 18. As previously discussed, if the connector 18 has one end closed, such configuration also acts as a stop structure to prevent the pegboard members 12,14 from sliding out of the connector 18. It is also understood that the first connector 18 may also be suitably mounted to the wall. A pegboard assembly 10 having a pair of pegboard members 12,14 utilizing a first connector 18 is formed.

As previously discussed, FIG. 1 shows a pegboard assembly 10 utilizing four pegboard members. Thus, it is understood that the second pegboard member 14 has a second peripheral edge having a T-shaped tongue 42 extending therefrom. A second connector 120 is utilized generally identical to the first connector 18. Thus, the second T-shaped tongue 42 of the second pegboard member 14 is received in a first groove of the second connector 120. As further shown in FIG. 1, a third pegboard member 112 having a first T-shaped tongue 42 is positioned such that its first T-shaped tongue 42 is received in the second groove of the second connector 120. Similarly, a third connector 122 is connected in identical fashion such that a second T-shaped tongue on the third pegboard member 112 is received in a first groove of the third connector. Finally, a fourth pegboard member 114 having a first T-shaped tongue 42 is received in the second groove of the third connector 122. It is understood that the plurality of pegboard members and connectors are operably connected together and are suitably connected to the wall. The cooperative structures 20 between the pegboard members and the connectors provide for a pegboard assembly having four pegboard members connected to one another in an enhanced configuration. It is understood that more or less pegboard members could be utilized in the pegboard assembly 10.

As previously discussed, the pegboard members have a second tongue 44 that is generally transverse to the first tongue 42. In one embodiment, the second tongue 44 may be located on a horizontal bottom of the pegboard member 12. As shown in FIG. 2, a connector 130 could also be connected to this horizontally-oriented tongue 44 such that another pegboard member 132 may be connected to a bottom portion of the first pegboard member 12. Because the pegboard members have tongues 42,44 around generally a full periphery of the pegboard members 12, multiple configurations for connecting the pegboard members together are possible as can be appreciated from FIGS. 1 and 2. It is further contemplated that the additional pegboard member 132 shown in FIG. 2 could be connected such that its longer side dimension can be connected to the horizontal connector 130. FIG. 9 also shows additional connection configurations using the second tongue 44.

In one embodiment, a user may mount the first pegboard member 12 to a wall as discussed. The user then slides the connector 18 onto the first pegboard member 12 wherein the tongue 42 slides in the groove 24. Frictional engagement between the tongue 42 and the groove 24 keeps the connector 18 engaged with the pegboard member 12. A user can then connect the second pegboard member 14 to the connector 18 as discussed. Additional pegboard members and connectors can also be connected as desired.

As discussed, a preferred form of the cooperative structure 20 includes a T-shaped tongue and a T-shaped groove. It is understood that other cooperative connection structures could be utilized between pegboard members. In particular, other tongue and groove arrangements or other male/female structures can be utilized to connect the plastic pegboard members together. Further, the pegboard members may utilize structure having an interference fit between members. A connector utilizing an interference fit with a pegboard member may also be utilized. Finally, a connector can be provided wherein the cooperative structure is completely provided between the pegboard members. One pegboard member may have a first structure that cooperates directly with another structure on another pegboard member. For example, a first pegboard member may have a tongue that is received by a groove on a second pegboard member. In such configuration, the connector having cooperative structure is associated with the pegboard members by being integral with the pegboard members. Other cooperative structures are also contemplated.

Thus, it can be appreciated that the plastic pegboard member having an integral spacer element 50 provides an enhanced mounting configuration against a wall. The integral spacer element 50 assures a space will be maintained between the rear side 48 of the pegboard member 12 and the wall to allow for hooks to be readily inserted into the holes 16. The hooks will not abut the wall preventing proper insertion into the holes 16. Because the spacer element 50 is integral with the pegboard member 12, a separate spacer structure is not necessary, which is often cumbersome to properly connect. The integral configuration of the spacer element extending from the reinforcing rib also provides an enhanced, simple construction. The cooperative structure 20 between the pegboard member 12 and the connector 18 allows multiple pegboard members 12 to be easily connected to one another. This has not been possible with prior art pegboards made of wood or plastic. The cooperative structure 20 allow a user to create a pegboard assembly 10 having various configurations as desired. The cooperative structure 20 further provides for an aesthetically pleasing mounting configuration.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

What is claimed is:

1. A plastic pegboard mounted on a wall, the plastic pegboard comprising:

a plastic pegboard member having a front side and a rear side, and having a plurality of holes defined therethrough, the rear side having a reinforcing rib, wherein the reinforcing rib comprises a first reinforcing member intersecting a second reinforcing member, the pegboard member further having a spacer element extending from the reinforcing rib and extending away from the front side, wherein the spacer element is adapted to contact the wall such that the holes are adapted to be spaced from the wall, wherein the spacer element has a first spacer member intersecting a second spacer member, the first spacer member extending from the first reinforcing member and the second spacer member extending from the second reinforcing member.

2. The plastic pegboard of claim 1, wherein the reinforcing rib and spacer element are integral with the pegboard member.

3. The plastic pegboard of claim 1, wherein the reinforcing rib comprises a plurality of intersecting reinforcing members that define a plurality of intersection areas, the spacer element comprising a plurality of spacer elements, a respective spacer element extending from each intersection area.

4. The plastic pegboard of claim 3, wherein the pegboard member has a peripheral edge, a tongue extending from the peripheral edge, the tongue adapted to cooperate with a connector wherein a plurality of pegboard members are connected together.

5. A plastic pegboard mounted on a wall, the plastic pegboard comprising:

a plastic pegboard member having a front side and a rear side, and having a plurality of holes defined therethrough, the rear side having a reinforcing rib, wherein the reinforcing rib comprises a first reinforcing member intersecting a second reinforcing member, the pegboard member further having a spacer element extending from the reinforcing rib and extending away from the front side, wherein the spacer element is adapted to contact the wall such that the holes are adapted to be spaced from the wall, wherein the spacer element has a first spacer member intersecting a second spacer member, the first spacer member extending from the first reinforcing member and the second spacer member extending from the second reinforcing member, wherein the pegboard member has a peripheral edge, a tongue extending from the peripheral edge, the tongue adapted to cooperate with a connector wherein a plurality of pegboard members are connected together.

* * * * *